United States Patent [19]

Fujita et al.

[11] 4,104,602

[45] Aug. 1, 1978

[54] PNEUMATIC TIMER

[75] Inventors: Teizo Fujita, Ibaraki; Shunzo Yoshida, Takatsuki; Toshio Koizumi, Kashihara, all of Japan

[73] Assignee: Izumi Denki Corporation, Osaka, Japan

[21] Appl. No.: 748,368

[22] Filed: Dec. 7, 1976

[30] Foreign Application Priority Data

Apr. 5, 1976 [JP] Japan ..... 51-38411

[51] Int. Cl.[2] ..... H01H 7/03

[52] U.S. Cl. ..... 335/61; 335/59

[58] Field of Search ..... 335/61, 62, 63, 64, 335/65, 29, 240, 59; 200/34

[56] References Cited

U.S. PATENT DOCUMENTS

| | | | |
|---|---|---|---|
| 1,604,669 | 10/1926 | Valkenburg | 335/61 |
| 2,855,481 | 10/1958 | Lindahl | 335/61 |
| 3,684,985 | 8/1972 | Flanagan | 335/61 |
| 3,711,797 | 1/1973 | Flanagan et al. | 335/61 |
| 3,775,710 | 11/1973 | Cook | 335/61 |
| 4,030,054 | 6/1977 | Kiessling | 335/61 |

*Primary Examiner*—Harold Broome

*Attorney, Agent, or Firm*—Birch, Stewart, Kolasch & Birch

[57] ABSTRACT

A pneumatic timer is disclosed which includes a base plate, a vertical frame member consisting of a frame perpendicular to the base plate and a horizontal frame. The horizontal frame portion includes a central opening, the vertical frame portion includes a pair of vertically extending grooves. A timing mechanism is received in the central opening in the horizontal frame portion including a displaceable element displaceable axially of the central opening in the base plate and a knob disposed on top of the horizontal frame portion. An electromagnet is fixed inside the vertical frame portion in a region surrounded with the horizontal and vertical frame portions. The electromagnet includes a plunger which has a connecting rod associated therewith and which is vertically movable in response to an input signal and is arranged so that in the normal condition it holds the displaceable element in its initial position but that upon energization of the electromagnet it allows vertically downward displacement of the displaceable element. Each of the pair of grooves in the vertical frame portion includes one of the two arms of a T-shaped lever received in the upper region thereof.

29 Claims, 13 Drawing Figures

FIG. 5
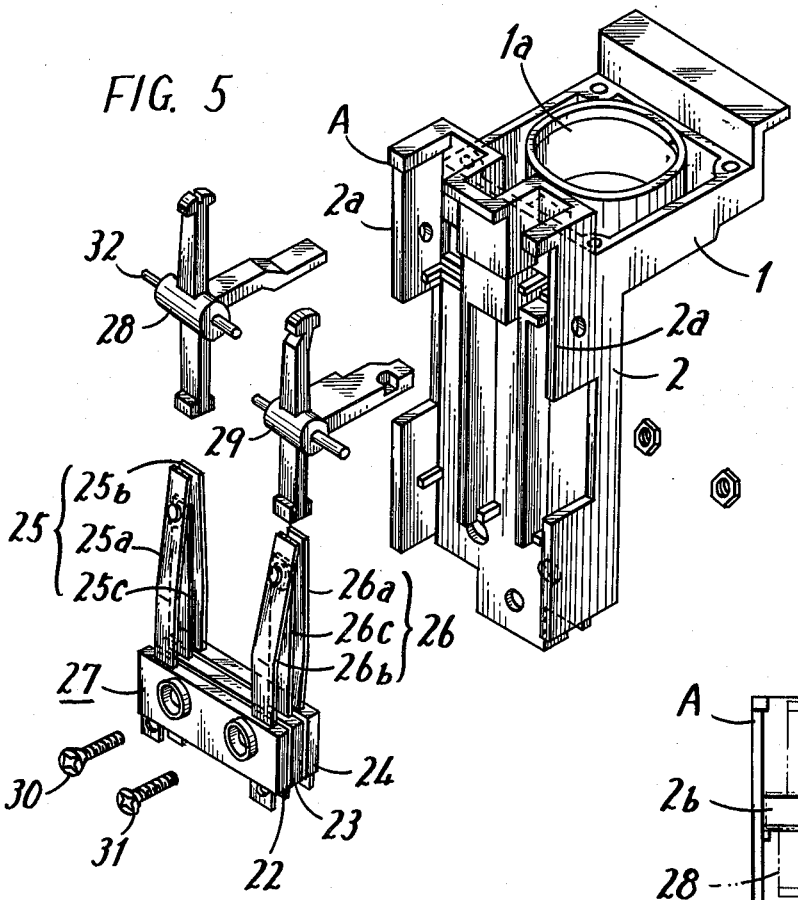
FIG. 6
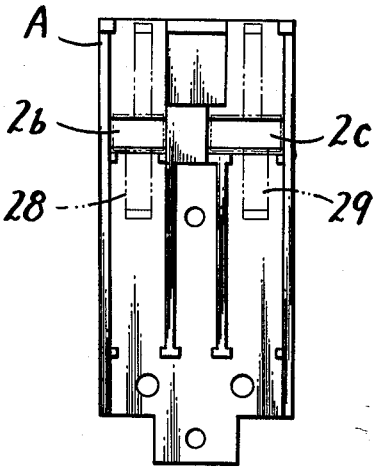
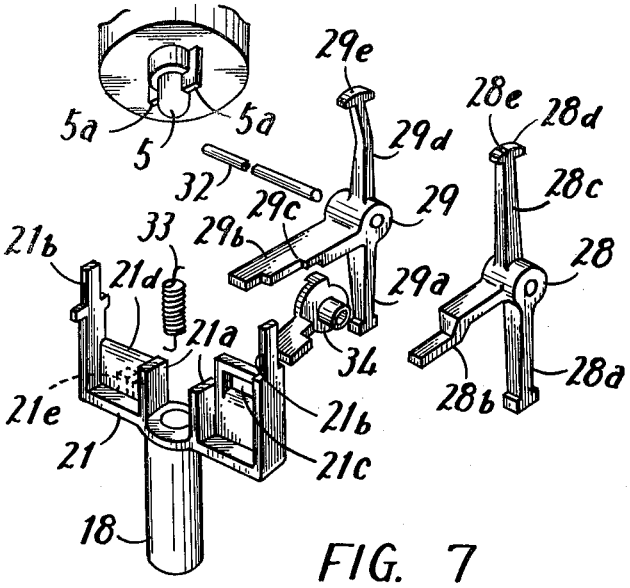
FIG. 7
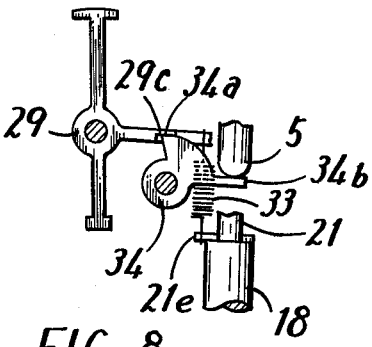
FIG. 8

PNEUMATIC TIMER

BACKGROUND OF THE INVENTION

1. Field of the Invention

The present invention relates to a pneumatic timer utilizing the flow resistance of air passing through a narrow passage to produce timing action of a timing member with which an electric switch mechanism is associated to provide an electric output.

2. Description of the Prior Art

A pneumatic timer is used to determine timing by utilizing the flow resistance of air. It is possible to determine timing for various intervals of time by making said flow resistance variable. Generally, a pneumatic timer comprises a timing mechanism which determines timing on the basis of time characteristics determinable as a function of the flow resistance of air, a solenoid mechanism for driving said timing mechanism, and an output mechanism which provides an electric output in accordance with the timing determined by said timing mechanism. Such pneumatic timer presents the following three technical problems: (1) How to construct and arrange in a compact manner said three mechanisms constituting the pneumatic timer; (2) how to facilitate the assembly of said three mechanisms; and (3) how to improve the accuracy of timing action.

However, conventional pneumatic timer designs have failed to offer a satisfactory solution to these problems. For example, when the three mechanisms, which are independently constructed, are assembled or connected together, the assembling error and the dimensional errors of the components of each mechanism directly influence the timing error. Further, the timing mechanism must act slowly while the output mechanism (switch mechanism) must act quickly. Conventionally, the switch mechanism operates on the principle of the snap action of a microswitch. However, such snap action characteristics differ among different switch mechanisms, presenting a problem concerning reliability. Conventionally, with a view to solving this problem, a fine adjusting screw is attached to said microswitch. The use of a microswitch in operative association with the slow action of said timing mechanism, however, is not desirable.

Further, in a pneumatic timer, since the displacing force of a displaceable member included in the timing mechanism is very small, it is required that control of the contact set of the switch mechanism can be effected with a very small force.

Furthermore, it is desirable that conversion between an ON-delay type timer in which timing action is started upon turning-on of power and an OFF-delay type timer in which timing action is started upon turning-off of power can be made as needed.

SUMMARY OF THE INVENTION

Accordingly, the principal object of the invention is to provide a pneumatic timer using a minimum number of simplified component parts which can be assembled with great ease.

Another object of the invention is to reduce the cost through adaptation to mass-production so that of the component parts, those associated with each other can be preassembled.

A further object of the invention is to provide an arrangement wherein the contacts in a contact mechanism are constituted by leaf springs and the direction in which the contacts are opened and closed is substantially at right angles to the direction of operation of the solenoid mechanism so as to eliminate a possibility that a shock produced upon operation of the solenoid mechanism will influence the contacts.

Still a further object of the invention is to facilitate the making of a block as a switch mechanism by locating an instantaneous contact set and a timing contact set at a single place, thereby saving the steps of assembly, and to enable conversion between ON-delay and OFF-delay.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

A pneumatic timer according to the invention comprises a pneumatic timing mechanism including a displaceable member adapted to be displaced from its initial position to its displaced position in a predetermined direction with time characteristics determined as a function of the flow resistance of. The timer includes means for providing an input signal; displacement allowing means operatively connected to said displaceable member and normally urging said displaceable member to said initial position but responsive to an input from said input providing means to allow the displacement of said displaceable member in said predetermined direction. In addition, the timer includes a contact mechanism disposed laterally of said displacement allowing means and operatively connected to said displaceable member and responsive to the displacement of said displaceable member to perform a switching action.

In a more preferable embodiment of the invention, said contact mechanism comprises a first lever rotatably provided according to the displacement of said displaceable member and having two arms extending at right angles to each other, one of said arms being operatively connected to said displaceable member. The contact mechanism includes a first sheet-like contact set extending in said predetermined direction and operatively connected to the other arm of said first lever, whereby said sheet-like contact set is opened and closed according to the rotating movement of said first lever. Said one arm of said first lever extends in a direction perpendicular to the direction of displacement of said displaceable member and said other arm extends in a direction parallel with the direction of displacement of said displaceable member. Said pneumatic timer further comprises means operatively connected to said displaceable member and to said one arm of said first lever for quickly rotating said first lever at the predetermined displaced position of said displaceable member, thereby quickly opening or closing said first contact set. In a more preferable embodiment of the invention, said displacement allowing means comprises electromagnetic means responsive to an input signal from said input providing means to be electromagnetically energized for instantaneously allowing the displacement of said displaceable member in said predetermined direction, and an operatively connecting member integrally connected to said electromagnetic means. Said operatively interconnected member, when in a predetermined position, is in a condition in which it is engaged with said displaceable member, whereby said operatively connecting member is instantaneously displaced in said predetermined direction in response to the energization of said electromagnetic means, while said displaceable member is displaced in said time characteristics of said displaceable member.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5 is an exploded perspective view of a frame body and a switch mechanism;

FIG. 6 is side view of the frame body;

FIG. 7 is an exploded perspective view showing the relation between the connecting member of a solenoid mechanism and the cam member of the switch member;

FIG. 8 is a schematic setup view showing the relation between a timing cam member and parts associated therewith;

DETAILED DESCRIPTION OF THE PREFERRED EMBODIMENTS

Figure 1:
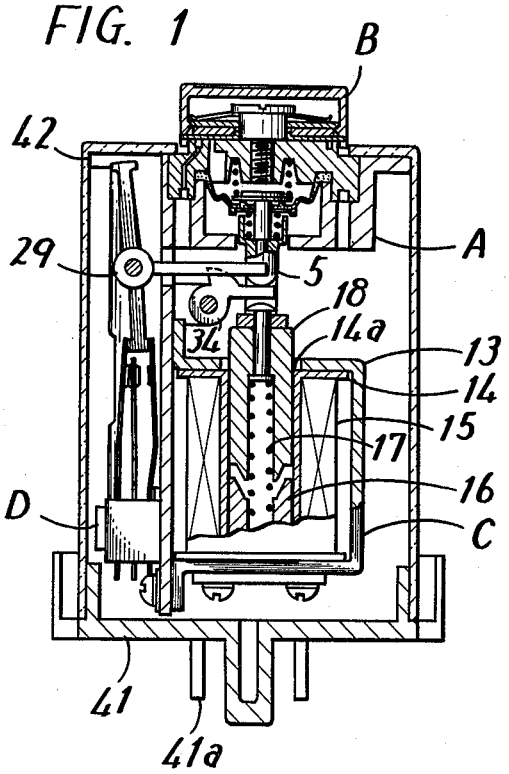
FIG. 1 is a front view, partly in longitudinal section, of a pneumatic timer according to an embodiment of the present invention.
Figure 2:
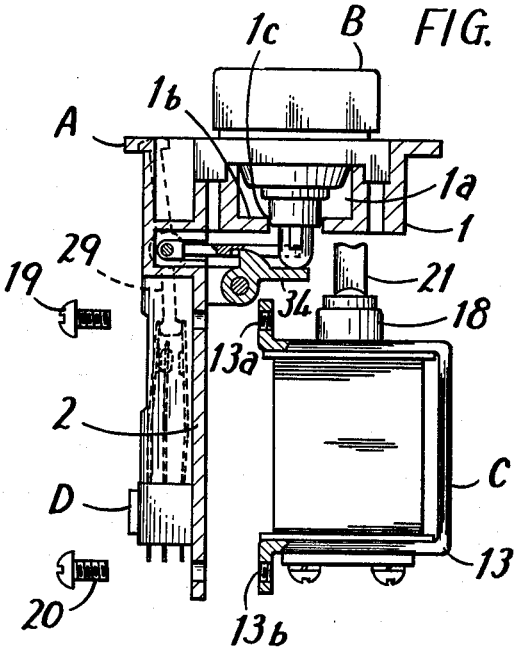
FIG. 2 is a front view, partly in longitudinal section, of the pneumatic timer in its final assembled condition.

Referring to FIGS. 1 and 2, a pneumatic timer according to an embodiment of the invention shown therein generally comprises a frame body A made of a synthetic resin molded into a substantially inverted L shape, a timing mechanism B attached to the horizontal portion 1 of said frame body A, an electromagnetic mechanism C attached to one side of the vertical portion 2 of said frame body A, and a switch mechanism D attached to the other side of said vertical portion 2.

Figure 3:
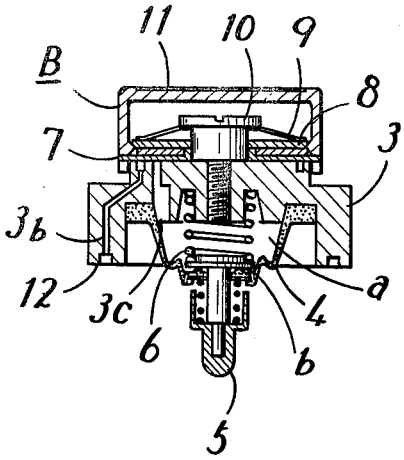
FIG. 3 is a longitudinal section of a timing mechanism shown in FIG. 1.
Figure 4:
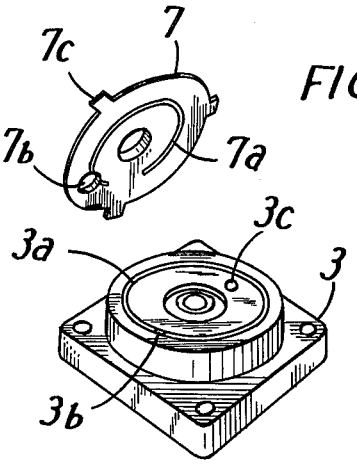
FIG. 4 is an exploded perspective view of the principal parts of the timing mechanism shown in FIG. 1.

Referring to FIGS. 3 and 4, said timing mechanism B comprises a base block 3 having an annular groove 3*a* for passage of air formed in the upper surface thereof, a first passage 3*b* communicating with said groove 3*a* and with the lower side of said base block and a second passage 3*c* offset from said groove 3*a* toward the center. A bellows 4 is disposed on the under side of said base block 3 and cooperating with the latter to define an air chamber *a*. An actuator 5 is attached to the center of said bellows 4. In addition, the timing mechanism B includes a return spring 6 for said bellows 4; an adjusting plate 7 rotatably mounted on top of said base block 3 and having a substantially C-shaped narrow groove 7*a* formed on the opposed surface thereof so as to have its axis overlapping the second passage 3*c* in the base block 3 and a shunting recess 7*b* disposed at one end of said narrow groove 7*a* to make a shunt between said narrow groove 7*a* and the groove 3*a* in said base block 3. Further, the timing mechanism B includes a retaining plate 8 for said adjusting plate 7; a retaining spring 9 urging said adjusting plate 7 against the base 3; a screw 10 for attaching said adjusting plate 7, retaining plate 8 and retaining spring 9 to the base 3; and a knob 11 under cover of which are said adjusting plate 7, retaining plate 8, retaining spring 9 and attaching screw 10. The said knob is engaged with tongues 7*c* formed around the circumference of the adjusting plate 7 so that the adjusting plate 7 may be rotated. In the timing mechanism B constructed in the manner described above, the first passage 3*b* in said base 3 opens to the outside at the lower end thereof and said second passage 3*c* communicates with the air chamber *a* defined by said bellows 4. When the bellows 4 is lowered by the return spring 6 from its initial lifted position, ambient air flows through the first passage 3*b* and annular groove 3*a* of the base block 3, through the shunting recess 7*b* and narrow groove 7*a* of the adjusting plate 7 and then through the second passage 3*c* from which it then enters the air chamber *a*. Thus, said bellows 4 makes a return movement while being influenced by the flow resistance of air flowing through the narrow passage 7*a* of said adjusting plate 7. Therefore, by rotating the knob 11 to vary the length of a portion of said narrow passage 7*a* extending from the second passage 3*c* in said base block 3 to the shunting recess 7*b* in the adjusting plate 7, it is possible to vary the length of time required for the bellows 4 to return. Usually, this return time can be varied within the range of about 0.2–60 seconds. In addition, interposed between said bellows 4 and the actuator 5 attached to the center of said bellows 4 is a valve *b* which is adapted to be closed during the return movement of the bellows 4 produced by the return spring 6 but which, when said actuator 5 and bellows 4 are pushed up by an associated member, allows the air in the air chamber *a* to flow out instantaneously through said valve *b*.

Referring to FIG. 2 again, the timing mechanism B has a recess 1*a* formed in the upper surface of the horizontal portion of said frame body A for receiving said bellows 4 therein so as to accommodate the movement of the bellows 4 and actuator 5, with the latter projecting downwardly through a hole 1*c* formed in the lower wall 1*b* of said recess 1*a*. Designated at 12 is a filter.

The electromagnetic or solenoid mechanism C comprises a substantially U-shaped yoke 13 positioned below said timing mechanism B and attached to the inner side of the vertical portion 2 of said frame body A. The solenoid C includes a magnetic coil 15 wound on a bobbin 14, a fixed iron core 16 secured to the lower end of a central hole 14*a* in said bobbin 14, and a movable iron core 18 vertically slidably inserted in said hole 14*a* and normally upwardly urged by a spring 17, with its lower end spaced apart from and opposed to said fixed iron core 16, as best shown in FIG. 1. The solenoid mechanism C arranged in the manner described above is attached to the vertical portion 2 of said frame body A by screws 19 and 20 at attaching regions 13*a* and 13*b* defined by bending the upper and lower ends of said yoke 13. The solenoid mechanism C has its operation associated with said timing mechanism B and the switch mechanism D which is to be presently described, the operative association concerned being established in such a manner that, as seen in FIG. 7, the shoulders 21*a*, 21*a* of a connecting member 21 attached to the upper end of the movable iron core 18 are opposed to projections 5*a*, 5*a* provided on the actuator 5 of said timing mechanism B. Thus, when the solenoid mechanism C is in the deenergized condition, the actuator 5 is held lifted by the connecting member 21 with the return spring 6 of the bellows 4 storing energy therein (initial condition). As soon as the movable iron core 18 is attracted toward the fixed iron core 16 upon energization of said solenoid mechanism C, the actuator 5 is allowed to descend under the action of the return spring 6. The connecting member 21 is adapted to be vertically moved while being guided in that guide elements 21*b*, 21*b* upwardly projecting from its end are inserted in guide holes 1*d*, 1*d* formed in the under side of the horizontal portion 1 of the frame body A. As for operative association between said solenoid mechanism C and said switch mechanism D, this will be later described.

Figure 9:
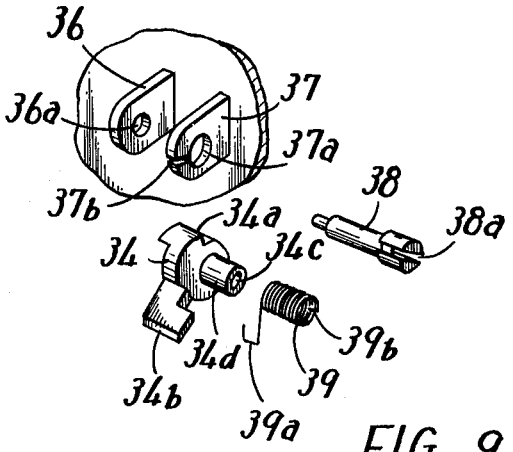
FIG. 9 is an exploded perspective view showing the attaching construction of a trip lever.
Figure 10:
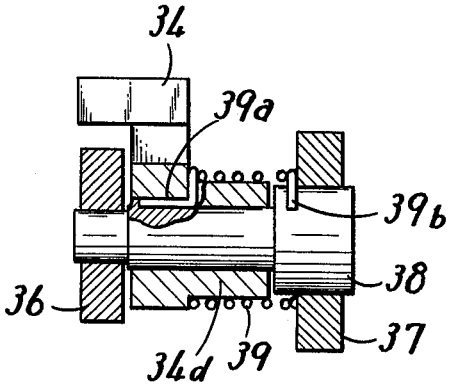
FIG. 10 is a longitudinal section showing the attaching construction of the trip lever.
Figure 11:
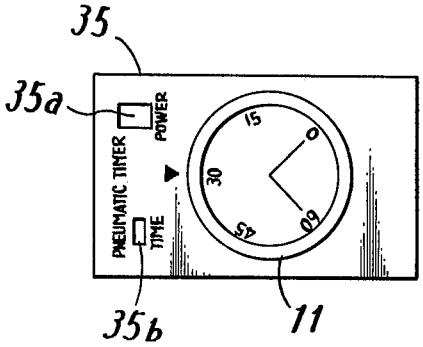
FIG. 11 is a plan view of a name plate and a knob.

Referring particularly to FIG. 5, the switch mechanism D comprises a contact spring strip assembly 27 including movable contact plates 25*a*, 25*b* and a fixed contact plate 25*c* secured at their lower ends to insulating blocks 22, 23 and 24 to constitute an instantaneous contact set 25. The and movable contact plates 26*a*, 26*b* and a fixed contact plate 26*c* secured at their lower ends to said insulating blocks constitute a timing contact set 26. In addition, and an instantaneous cam member 28 and a timing cam member 29 are disposed above said contact spring strip assembly 27 and serve to open and close said instantaneous contact set 25 and said timing contact set 26, respectively. Said contact spring strip assembly 27 is secured at its insulating blocks 22, 23, 24 to the lower end of the vertical portion 2 of the frame body A by screws 30 and 31 so as to be disposed substantially parallel with the direction of movement of the movable iron core 18 of the solenoid mechanism C. The while said instantaneous and timing cam members 28 and 29 are pivotally mounted on a pin 32 transversely extending between side plates 2*a*, 2*a* projecting from opposite sides of the vertical portion 2 of the frame body A. The instantaneous and timing cam members 28 and 29 are substantially ⊢ -shaped with the lower ends of their lower vertical portions 28*a* and 29*a* interposed between the movable contact plates of the instantaneous and timing contact sets 25 and 26, respectively, of the contact string strip assembly 27. Therefore, so that upon clockwise or counterclockwise rotating of said cam members 28 and 29 around the axis of said pin 32, they open or close said instantaneous and timing contact sets 25 and 26 (see FIG. 5). The instantaneous cam member 28 has its horizontal portion 28*b* projecting through a window opening 2*b* formed in the vertical portion 2 of the frame body A until its front end is fitted in an engagement window 21*c* formed in the connecting member 21, whereby according to the vertical movement of the movable iron core 18 produced upon energization or deenergization of the solenoid mechanism C, the instantaneous cam member 28 is rotated clockwise or counterclockwise. As for the timing cam member 29, its horizontal portion 29*a* projects through a window opening 2*c* formed in the frame body A, as in the case of said instantaneous cam member, but the front end of said horizontal portion rests on the shoulder portion 21*d* of said connecting member 21 with a spring 33 having its opposite ends locked between the locking portion 21*e* of the connecting member 21 and the horizontal portion 29*b* so as to impart a clockwise torque to the timing cam member 29 (see FIGS. 7 and 8). Further, said timing cam member 29 is provided with an engagement portion 29*c* in the central region of the horizontal portion 29*b*, said engagement portion 29*c* being engageably and disengageably associated with the engagement portion 34*a* of a trip lever 34 adapted to be rotated in response to the movement of the actuator 5 of the timing mechanism B. Thus, in normal condition, said timing cam member 29 keeps its engagement portion 29*c* engaged with the engagement portion 34*a* of said trip lever 34 so that the clockwise rotating of the timing cam member is prevented. When said trip lever 34 is rotated clockwise in response to the movement of the actuator 5 of said timing mechanism B and is disengaged from the engagement portion 29*c*, the clockwise rotating of the timing cam member 29 is permitted (see FIGS. 7–9). In other words, the attraction of the movable iron core 18 upon energization of said solenoid mechanism C results in the cam member 29 causing the spring 33, which has its opposite ends locked between the cam member 29 and the connecting member 21, to store energy therein, and upon the lapse of a predetermined period of time, the energy stored in the spring 33 rotates the cam member 29 clockwise, so that the vertical portion 29*a* operates the timing contact set 26 to produce a timing signal. In addition, the instantaneous and timing cam members 28 and 29 have indicating portions 28*d* and 29*e* (FIG. 7) formed on the upper ends of their upper vertical portions 28*c* and 29*d*, respectively. The indicating portions 28*d* and 29*e* are being opposed to regions close to window openings 35*a* and 35*b* formed in a name plate 35 (FIG. 11) placed on top of the frame body A. Upon rotation said indicating portions 28*d* and 29*e* may indicate the operating conditions through said window openings 35*a* and 35*b*. Further, referring to FIG. 7, the instantaneous cam member 28 is provided with a slot 28*e* in the indicating portion 28*d* adapted to receive a screw-driver-like tool. Therefore, by manually rotating the instantaneous cam member 28 by using a suitable tool, it is possible to open and close the instantaneous contact set 25 while depressing the connecting member 21 to make a simulation of the energized condition of the solenoid mechanism C for an operation check or a timing adjustment. Though not shown, the instantaneous cam member 28 may, of course, be provided with a projection rather than said slot 28*e* so as enable direct push and pull of said projection by means of an individual's fingers. The trip lever 34 is operatively associated with the timing cam member 29 and the actuator 5 of the timing mechanism B and is pivotally mounted on a support pin 38 transversely supported in support elements 36 and 37 projecting from the inner surface of the vertical portion 2 of the frame body A, with the end 34*b* opposed to the lower end of the actuator 5. The trip lever 34 is constantly urged for counterclockwise rotation by a coil spring 39 having one end 39*a* thereof locked to said trip lever 34, with the end 34*b* constantly pressed against the lower end of the actuator 5. The strength of said coil spring 39 is, of course, much lower than that of the return spring 6 of the timing mechanism B and hence it is not such that it prevents the actuator 5 from descending under the action of the return spring 6. However, the coil spring 39 is capable of influencing the rate of downward movement of the actuator 5 under the action of the return spring 6. More particularly, the strength of the coil spring 39, together with the flow resistance of air entering the air chamber *a* of the timing mechanism B, influences the timing. The coil spring 39 is wound on the boss 34*d* of the trip lever 34 provided with an opening 34c, with one end 39a of said coil spring locked to the trip lever 34 and the other end 39b inwardly bent and fitted in a slot 38a formed in the support pin 38, which support pin is pressed into openings 36a and 37a formed in the support elements 36 and 37. One support element 37 is provided with a slit 37b communicating with the opening 37a so as to have a sufficient amount of resilience to firmly grip the support pin 38 lest the support pin 38 be rotated by said coil spring 39 or by vibrations. Further, the support pin 38 is increased in diameter in the region where said slit 38a exists to have substantially the same diameter as that of the boss 34d. If, therefore, the coil spring 39 is fitted on the boss 34d of the trip lever 34 and positioned between the support elements 36 and 37 and then the support pin 38 is inserted through the opening 37a of one support element 37, one end 39b of the coil spring 39 can be locked in the slit 38a of the support pin 38 simultaneously with assembly. With the coil spring thus assembled, the support pin 38 may be rotated by a tool such as a screw-driver in order to vary the strength of the torque to be imparted to the trip lever 34, and this variation, together with the variation of the flow resistance of air in the timing mechanism B, can be utilized to adjust the timing. In practice, such adjustment by the coil spring 39 serves to make up for the scatter in the characteristics of the return springs, such as the spring 6, induced during production thereof, to provide a definite design spring strength which, in turn, provides a definite relation between the angle of rotation of the knob 11 rotating the adjusting plate 7 and the graduations on the dial plate.

It will now be understood from the above that according to the timing mechanism of the invention, as soon as the connecting member 21 secured to the movable iron core 18 is lowered upon energization of the solenoid mechanism C, the instantaneous cam member 28 is rotated to thereby produce an instantaneous signal. At this time the timing cam member 29, urged for rotation by the spring 33 locked between it and the connecting member 21, is held against rotation by engagement with the trip lever 34. Therefore, and it is not until the actuator 5 descends according to a preset timing established by the timing mechanism B so as to rotate the trip lever 34 through a sufficient angle to free the timing cam member 29 that the latter is rotated to thereby produce a timing signal. It goes without saying that upon deenergization of the solenoid mechanism C, the timing and instantaneous cam members 28 and 29 push up the horizontal portions 28a and 29a, respectively, and at the same time the connecting member 21 lifts the actuator 5 while the trip lever 34 is rotated counterclockwise by the coil spring 39 to return to the original condition.

While the above refers to an ON-delay type construction, the following is a description of a case in which the above construction is modified to provide an OFF-delay type construction.

Figure 12:
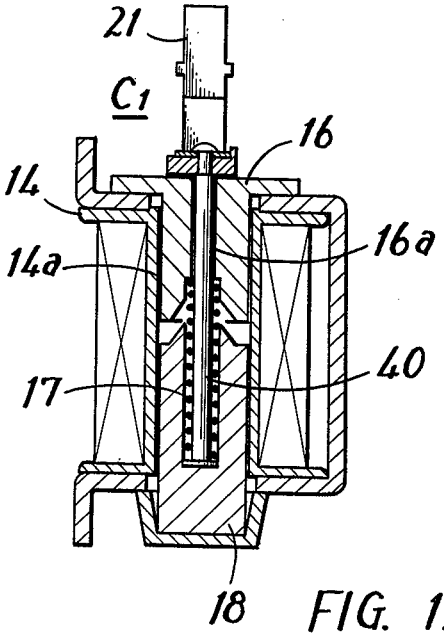
FIG. 12 is a longitudinal section of an OFF-delay type solenoid mechanism.
Figure 13:
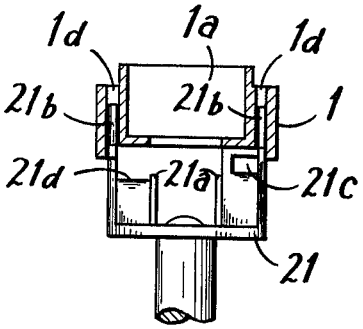
FIG. 13 is a view, partly in longitudinal section, showing the relation between the connecting member and the frame body.

The solenoid mechanism C1 in this embodiment of the invention, as shown in FIG. 12, comprises a fixed iron core 16 secured at the top in an opening 14a in a bobbin 14. A movable iron core 18 is disposed below and opposed to said fixed iron core 18, and an operating lever 40 is adapted to cooperate with said movable iron core 18 and upwardly projects through an opening 16a in said fixed iron core 16, with the above-described connecting lever 21 attached to the upper end of said operating lever. In other words, in this solenoid mechanism Cl, the solenoid mechanism C of the ON-delay type, with its component parts unchanged, is turned through 180°, or upside down, and then the operating lever 40 is attached thereto. The operative association among the solenoid mechanism C1, timing mechanism B and switch mechanism C is such that in energized the condition, the operating lever 40 is in its upper position where the connecting member 21 attached to the upper end of this operating lever 40 has pushed up the actuator 5. Upon deenergization, the operating lever 40, together with the movable iron core 18, is depressed to its lower position under the action of the spring 17 to produce an instantaneous signal and concurrently start the timing operation of the timing mechanism B.

As for the rest, 41 designates a base having plug terminals 41a projecting from the lower side thereof, and 42 designates a case. The present invention described above is such that in an aspect of assembly, pre-assembly is first carried out by attaching the timing mechanism B, switch mechanism D and trip lever 34 to the frame body A and then the solenoid mechanism C is attached to the frame body A. In and that in an aspect of arrangement, the number of parts is minimized, with all the component parts attached to the frame body A. As a result, dimensional scattering among members cooperating with each other can be eliminated to increase accuracy and a superior resistance to vibration and shock can also be achieved.

While the timing mechanism B has been shown as using an adjusting plate 7 formed with a narrow passage in the embodiments described above, a timing mechanism using other narrow passage means, for example, a needle construction known per se may, of course, be employed.

Although this invention has been described and illustrated in detail, it is to be clearly understood that the same is by way of illustration and example only and is not to be taken by way of limitation, the spirit and scope of this invention being limited only by the terms of the appended claims.

What is claimed is:

1. A pneumatic timer, comprising:

a pneumatic timing mechanism including displacement means adapted to be displaced in a predetermined direction from an initial position to a displaced position with a time characteristic determined as a function of a pneumatic resistance;

means for providing an input signal;

means operatively coupled to said displacement means for normally urging said displacement means toward said initial position and for allowing displacement of said displacement means in said predetermined displacement direction in response to said input signal;

contact means provided laterally of at least one of said timing mechanism and said displacement allowing means and operatively coupled to said displacement means and responsive to displacement of said displacement means for effecting a switching operation for generating an output signal;

said contact means including a first cam rotatably provided in association with the displacement of said displacement means, said first cam comprising one arm operatively coupled to said displacement means and the other arm extending in the direction perpendicular to said one arm; and a first leaf contact member extending in the same direction as said predetermined displacement direction and operatively coupled to the other arm of said first cam, whereby said leaf contact member is switch operated in association with rotation of said first cam.

2. A pneumatic timer in accordance with claim 1, wherein said other arm of said first cam further extends in the direction opposite to the direction of said first leaf contact member, the end portion of said opposite extending portion being adapted to display the rotation of said first cam.

3. A pneumatic timer in accordance with claim 1, wherein said one arm of said first cam extends in the direction perpendicular to the displacement direction of said displacement means and said other arm of said first cam extends in the direction parallel to the displacement direction of said displacement means.

4. A pneumatic timer in accordance with claim 1, which further comprises means operatively coupled to said displacement means and said one arm of said first cam for abruptly rotating said first cam at a predetermined displaced position of said displacement means for abruptly switching said first leaf contact member; and said abrupt rotating means comprising engaging means for engaging said displacement means with said first cam, said engaging means being adapted to be displaced by said displacement means for releasing engagement with said one arm of said first cam at a predetermined displaced position, whereby said first angle is abruptly rotated.

5. A pneumatic timer in accordance with claim 4, wherein said abrupt rotating means comprises first urging means for urging said engaging means toward said initial position of said displacement means for self returning, the urging force of said first urging means being selected so as not to prevent said displacement means from being displaced.

6. A pneumatic timer in accordance with claim 4, wherein said abrupt rotating means comprises second urging means operatively coupled to said displacement allowing means for urging said first cam in association with allowing of displacement by said displacement allowing means.

7. A pneumatic timer in accordance with claim 4, wherein said engaging means comprises an engaging member extending in the direction perpendicular to the displacement direction of said displacement means;

operative coupling of said displacement means and said first cam is established by formation of an engaging state of said displacement means with said engaging member of said engaging means; and said engaging means is moved in accordance with the displacement of said displacement means as said displacement allowing means allows for displacement, whereby said engaging means releases engagement with said first cam at said predetermined displaced position.

8. A pneumatic timer in accordance with claim 1, wherein said contact means further comprises a second cam rotatably provided and comprising one arm and a other arm extending in the direction perpendicular to said one arm, said one arm of said second cam being in a gang engaging state with said displacement allowing means such that it is rotated in the displacement allowing direction simultaneously with movement of said displacement allowing means, and a second leaf contact member extending in the same direction as said predetermined displacement direction and operatively coupled to said other arm of said second cam.

9. A pneumatic timer in accordance with claim 8, wherein the other arm of said first cam and said first leaf contact member provided in alignment therewith are provided in parallel with and spaced from the other arm of said second cam and said second leaf contact member provided in alignment therewith.

10. A pneumatic timer in accordance with claim 1, wherein said displacement allowing means comprises an electromagnetic means responsive to the input signal from said input signal providing means to be electromagnetically energized for instantaneously allowing displacement of said displacement means in said predetermined displacement direction; and an operative connecting means connected to said electromagnetic means; and said operative connecting means being in an abutting contact with said displacement means at said predetermined position, whereby said operative connecting means is instantaneously displaced in said predetermined direction in response to energization of said electromagnetic means, while said displacement means is displaced in said time characteristic of said displacement means.

11. A pneumatic timer in accordance with claim 10, wherein said contact means comprises:

a first cam comprising one arm extending in the direction perpendicular to said displacement means and the other arm extending in the direction perpendicular to said one arm and provided rotatably in association with the displacement of said displacement means;

a second cam comprising one arm extending in the direction perpendicular to said displacement means and the other arm extending in the direction perpendicular to said one arm and provided rotatably in association with the movement of said displacement allowing means; and said operative connecting means comprising an abutting portion for stopping rotation of said first cam, and an engaging aperture for engaging with said one arm of said second cam.

12. A pneumatic timer in accordance with claim 11, wherein the other arm of said first cam and the other arm of said second cam are spaced in the opposite directions from the center and provided in parallel with each other, and said displacement means is in an abutting contact with said operative connecting means at the position intermediate said abutting portion and said engaging aperture.

13. A pneumatic timer, comprising:

a pneumatic timing mechanism including a displacement means adapted to be displaced from an initial position to a displaced position in a predetermined direction with a time characteristic determined as a function of a pneumatic resistance;

means for providing an input signal;

means operatively coupled to said displacement means for normally urging said displacement means toward said initial position and for allowing displacement of said displacement means in said predetermined displacement direction in response to the input signal from said input signal providing means;

contact means provided laterally of said displacement allowing means and operatively coupled to said displacement means for effecting a switching operation in response to the displacement of said displacement means for generating an output signal;

a frame member comprising a first frame portion and a second frame portion extending in the direction perpendicular to said first frame portion;

said pneumatic timing mechanism being mounted on said first frame portion, said contact means being mounted on said second frame portion, and said displacement allowing means being mounted in the region defined by said first frame portion and said second frame portion;

said contact means including a first cam rotatably provided on said frame member in association with the displacement of said displacement means, said first cam comprising one arm operatively coupled to said displacement means and the other arm extending in the direction perpendicular to said one arm; and a first leaf contact member extending in the same direction as said predetermined displacement direction and operatively coupled to the other arm of said first cam, whereby said leaf contact member is switch operated in association with rotation of said first cam.

14. A pneumatic timer in accordance with claim 13, wherein said second frame portion is formed of a groove on the outer surface thereof along the direction of said second frame portion for mounting said contact means; and said groove on the outer surface of said second frame portion comprising a first groove portion for positioning said other arm of said first cam and said first leaf contact member.

15. A pneumatic timer in accordance with claim 13, wherein said contact means further comprises:

a second cam rotatably mounted on said frame member and having one arm and the other arm extending in the direction perpendicular to said one arm, said one arm of said second cam being in an integral engaging state with said displacement allowing means such that it is rotated in the displacement allowing direction simultaneously with allowing of the displacement of said displacement allowing means; and a second leaf contact member extending in the same direction as said predetermined direction and operatively coupled to said other arm of said second cam.

16. A pneumatic timer in accordance with claim 15, wherein said second frame portion is formed of a groove on the outer surface thereof along the direction of said second frame portion for mounting said contact means;

said groove on the outer surface of said second frame portion comprising a first groove portion for positioning said other arm of said first cam and said first leaf contact member, and a second groove portion for positioning said other arm of said second cam and said second leaf contact member; and said first groove having a first aperture formed at the bottom thereof for allowing said one arm of said first cam to protrude from said first groove portion toward said region defined by said first and second frame portions, and said second groove portion having a second aperture formed at the bottom thereof for allowing said one arm of said second cam to protrude from said second groove portion toward said region defined by said first and second frame portions.

17. A pneumatic timer in accordance with claim 13, wherein a recess is formed on the outer surface of said first frame portion for mounting said pneumatic timing mechanism, and an aperture is formed in the central bottom portion of said recess for slidably inserting said displacement means.

18. A pneumatic timer in accordance with claim 17, wherein adjusting means is provided on the outer surface of said first frame for adjusting the timing characteristic of said pneumatic timing mechanism.

19. A pneumatic timer in accordance with claim 15, wherein said first and second cam are commonly and rotatably supported by means of a single shaft extending in the direction perpendicular to said first and second grooves on the outer surface of said second frame portion.

20. A pneumatic timer in accordance with claim 16, wherein said first and second grooves formed on the outer surface of said second frame extend to the outer surface of said first frame where display windows are formed, and said first and second cam provided in said first and second grooves, respectively, are each formed of a third arm in the direction opposite to the other arm thereof, said third arm extending to said display window of each of said first and second grooves, whereby displacement of said first and second cam are displayed through said display windows.

21. A pneumatic timer in accordance with claim 5, which further comprises:

a frame member comprising a first frame portion and a second frame portion extending in the direction perpendicular to said first frame portion;

said timing mechanism being mounted on said first frame portion;

said contact means being mounted on said second frame portion; and said displacement allowing means being provided in the space defined by said first frame portion and said second frame portion, and said second frame portion being provided with supporting means on the inner surface thereof for supporting rotatably said engaging means of said abrupt rotating means.

22. A pneumatic timer in accordance with claim 21, wherein said supporting means comprises a pair of protruding supporter formed to protrude on the inner surface of said second frame, which support said engaging means by sandwiching the same between said pair of protruding supporters.

23. A pneumatic timer in accordance with claim 22, wherein said engaging means comprises a protruding abutting portion for engaging with said displacement means, an offset portion for engaging with one arm of said first cam, and a cylindrical portion.

24. A pneumatic timer in accordance with claim 23, wherein:

said pair of protruding supporters each comprise an aperture at the center thereof;

said engaging means comprises an aperture formed through said cylindrical portion;

said abrupt rotating means comprises a coil spring for urging said engaging means toward the initial position of said displacement means for self returning; and said supporting means further comprises a supporting pin being inserted through the apertures of said protruding supporters and the aperture of said engaging means for pivotally supporting said engaging means between said protruding supporters.

25. A pneumatic timer in accordance with claim 24, wherein said engaging means further comprises means for fine adjusting the urging force of said first urging means.

26. A pneumatic timer in accordance with claim 25, wherein:

said fine adjusting means comprises said supporting pin;

said supporting pin has a groove on the end surface to which the end of said coil spring is fixed; and said end of said coil spring is folded to be hooked to said groove, whereby fine adjustment is made of the urging force of said coil spring through rotation of said supporting pin through said groove.

27. A pneumatic timer in accordance with claim 24, wherein the aperture of at least one of said pair of protruding supporters is partially formed of a slit groove, through which the end of said supporting pin is mounted to said aperture, whereby said supporting pin is elastically mounted.

28. A pneumatic timer in accordance with claim 1, wherein said displacement allowing means is adapted to allow the displacement of said displacement means from said initial position to said displaced position at the same time as the input signal is applied from said input signal providing means, and is adapted to return said displacement means from said displaced position to said initial position at the same time as said input signal is terminated.

29. A pneumatic timer in accordance with claim 1, wherein said displacement allowing means is adapted to allow the displacement of said displacement means from said initial position to said displaced position at the same time as the input signal from said input signal providing means is terminated and is adapted to return said displacement means from said displaced position to said initial position at the same time as said input signal is applied from said input signal providing means.

* * * * *